US007798361B2

(12) United States Patent
Clark et al.

(10) Patent No.: US 7,798,361 B2
(45) **Date of Patent: *Sep. 21, 2010**

(54) VENTED CONTAINER

(75) Inventors: Joseph M. Clark, Naugatuck, CT (US); Richard S. Chomik, Middlesex, NJ (US)

(73) Assignee: Playtex Products, Inc., Westport, CT (US)

( * ) Notice: Subject to any disclaimer, the term of this patent is extended or adjusted under 35 U.S.C. 154(b) by 141 days.

This patent is subject to a terminal disclaimer.

(21) Appl. No.: 11/710,812

(22) Filed: Feb. 26, 2007

(65) Prior Publication Data

US 2007/0158292 A1 Jul. 12, 2007

Related U.S. Application Data

(63) Continuation of application No. 10/302,775, filed on Nov. 22, 2002, now Pat. No. 7,201,284.

(60) Provisional application No. 60/333,564, filed on Nov. 27, 2001.

(51) Int. Cl.
*A61J 9/04* (2006.01)

(52) U.S. Cl. ..... 220/745; 215/11.5; 220/373

(58) Field of Classification Search ..... 215/11.5, 215/902; 220/913, DIG. 27, 745, 371, 372, 220/373, 703

See application file for complete search history.

(56) References Cited

U.S. PATENT DOCUMENTS

| | | | | |
|---|---|---|---|---|
| 921,387 | A | 5/1909 | Etter | 215/11.5 |
| 4,440,820 | A * | 4/1984 | Shiho et al. | 428/120 |
| 4,723,668 | A * | 2/1988 | Cheng | 215/11.5 |
| 4,728,006 | A | 3/1988 | Drobish et al. | 222/181.3 |
| 4,865,207 | A | 9/1989 | Joyner et al. | 215/11.5 |
| 5,499,729 | A | 3/1996 | Greenwood et al. | 215/11.5 |
| 5,597,881 | A | 1/1997 | Winter et al. | 526/348 |
| 6,138,710 | A | 10/2000 | Chomik et al. | 137/12.15 |
| 6,142,325 | A | 11/2000 | Chomik | 215/343 |
| 6,398,048 | B1 | 6/2002 | Kevorkian | 215/11.5 |
| 7,201,284 | B2 * | 4/2007 | Clark et al. | 215/11.5 |

FOREIGN PATENT DOCUMENTS

| | | |
|---|---|---|
| DE | 8002108 | 1/1980 |
| DE | 8305369 | 12/1983 |
| DE | 4036361 | 4/1991 |
| DE | 4229224 | 3/1994 |
| DE | 19520540 | 12/1996 |
| EP | 0593888 | 4/1994 |
| EP | 0895773 | 2/1999 |

* cited by examiner

*Primary Examiner*—Stephen Castellano
(74) *Attorney, Agent, or Firm*—Ohlandt, Greeley, Ruggiero & Perle, L.L.P.

(57) ABSTRACT

A container for holding a fluid that includes a hollow body defining an inner volume and an elastomeric membrane that is integrally formed with the hollow body forming a unitary container having a vent area. The vent area vents the inner volume such that air is selectively permitted to flow into the inner volume through the vent area and the fluid contained in the inner volume is substantially prevented from flowing out of the inner volume through the vent area. The elastomeric membrane is co-molded with the hollow body.

20 Claims, 5 Drawing Sheets

VENTED CONTAINER

CROSS REFERENCE TO RELATED APPLICATIONS

This application is a continuation of U.S. application Ser. No. 10/302,775, filed Nov. 22, 2002 now U.S. Pat. No. 7,201,284, which claims priority of U.S. Provisional Application No. 60/333,564/, filed Nov. 27, 2001, the disclosure of both of which are incorporated in their entirety herein by reference.

BACKGROUND OF THE INVENTION

1. Field of the Invention

The present disclosure relates to a spill proof cup assembly for holding and dispensing drinkable fluids. More particularly, the present disclosure relates to a spill proof cup assembly having a thermoplastic elastomer (TPE) co-molded bottom with a vent or vent mechanism disposed therein to dissipate the vacuum created as fluid is withdrawn from the cup.

2. Description of the Related Art

Spill proof cups having caps with a fluid outlet spout and an air inlet vent to permit drinking from the cup without creating an excessive vacuum in the cup, are well known. Further, many of these cups have valving mechanisms, typically coupled with the cap, via the spout and/or the air vent, that respond to the suction generated during drinking to allow fluid to exit the spout and allow air to enter the vent as a vacuum develops in the interior of the cup.

Despite the effectiveness of these different cup/cap mechanisms, the applicant has discovered a unique venting mechanism for venting a cup without having a vent located at an upper portion of a cup, without sacrificing the cup's resistance to spills/leaks, and requiring fewer parts. In addition, the present disclosure may also allow the cup to be formed of more brittle cup materials.

SUMMARY OF THE INVENTION

It is an object of the present disclosure to provide an improved spill proof cup assembly that is substantially leakproof.

It is another object of the present disclosure to provide such a spill proof cup assembly having a thermoplastic elastomer (TPE) co-molded bottom with a vent disposed therein.

It is still another object of the present disclosure to provide such a spill proof cup assembly that allows air to flow through the bottom of the cup via the vent to replace the volume of fluid as the fluid is removed.

It a further object of the present disclosure to provide a method of manufacture for a spill proof cup assembly having a TPE bottom with a vent disposed therein.

It is yet still a further object of the disclosure to provide a cup assembly having a soft, cushioned bottom portion for reducing the likelihood of cup breakage, resulting from dropping, and thereby allowing the cup assembly to be comprised of a wider range of materials, including more brittle materials.

These and other objects and advantages of the present disclosure are achieved by a spill proof cup assembly having a cup with an upper open portion and a bottom portion. The bottom portion has a vent disposed therein. The assembly preferably has a cap, with at least one fluid outlet, and adapted to enclose the upper open portion.

DETAILED DESCRIPTION OF THE INVENTION

Figure 1:
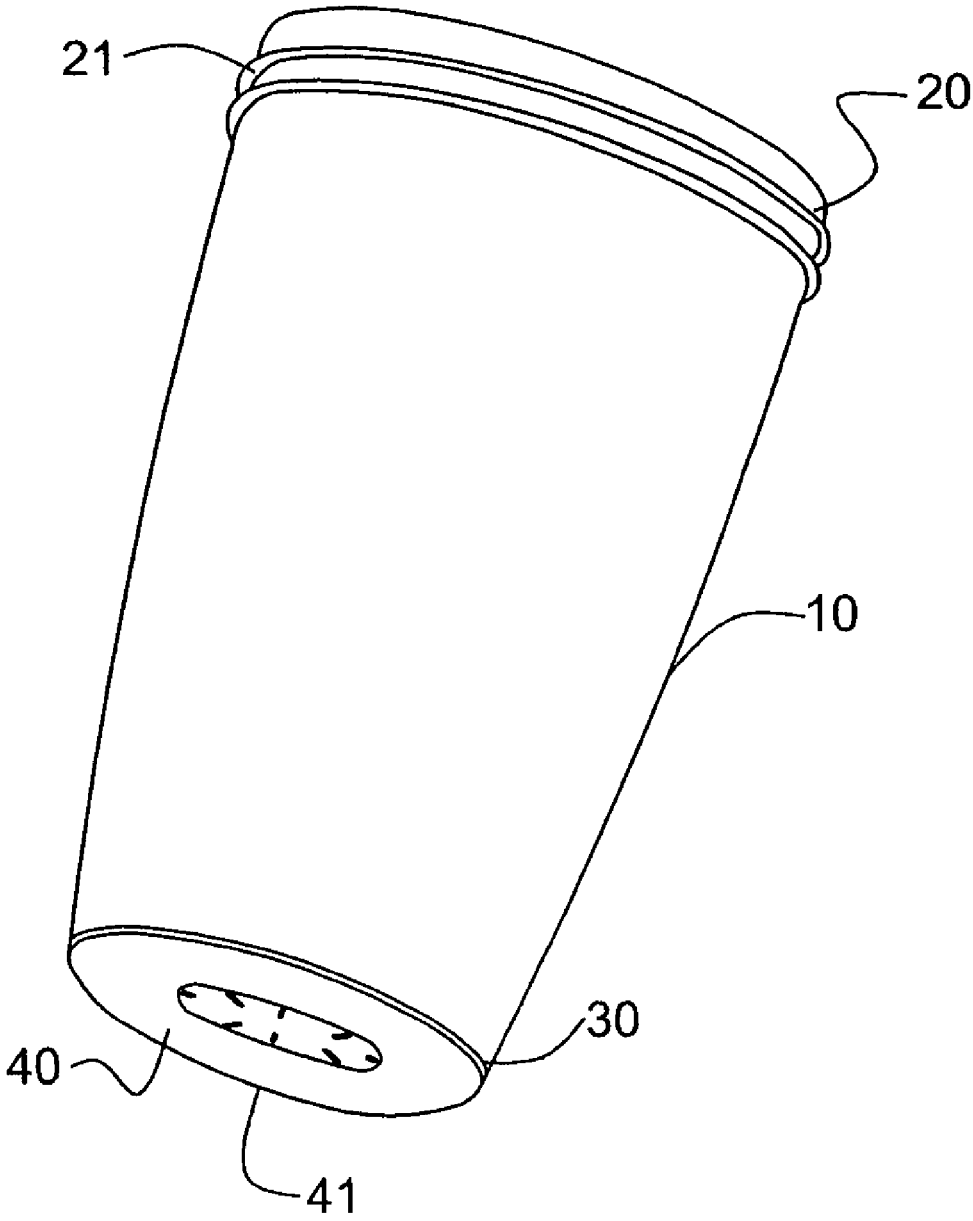
FIG. 1 is a perspective view of a cup assembly in accordance with the present disclosure.
Figure 3:
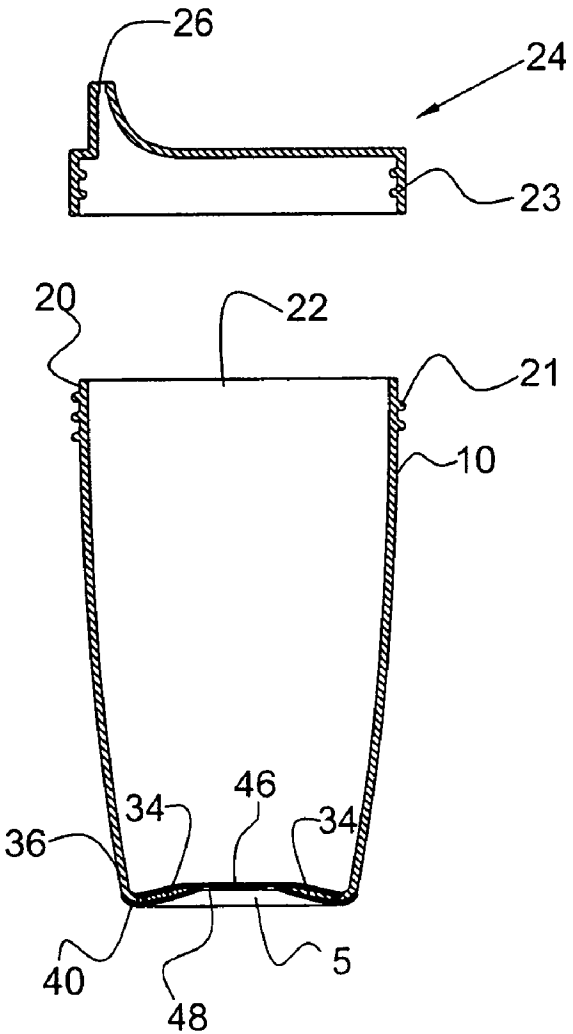
FIG. 3 is a side section view of the cup assembly of FIG. 1, highlighting the cup and co-molded TPE bottom.
Figure 2:
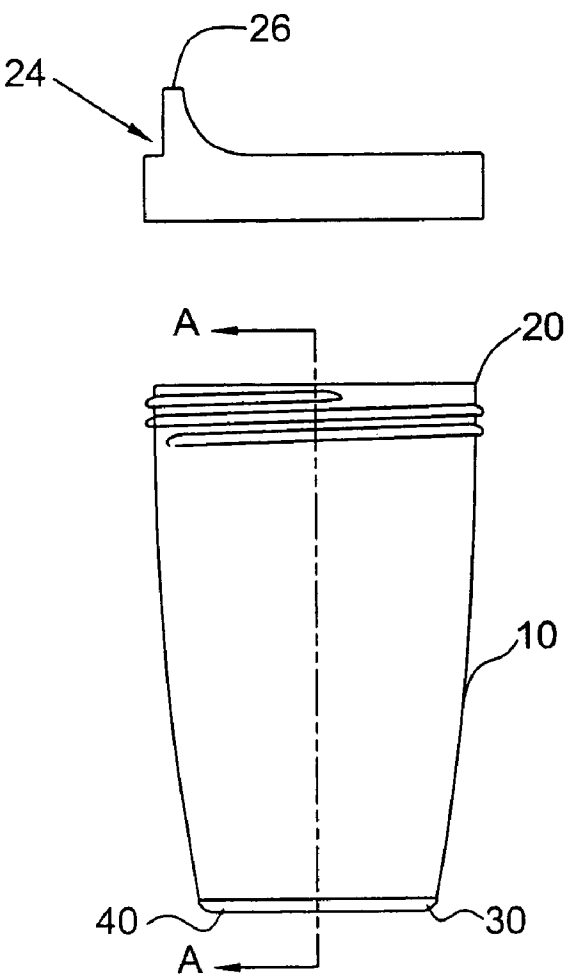
FIG. 2 is a side view of the cup assembly of FIG. 1.
Figure 4:
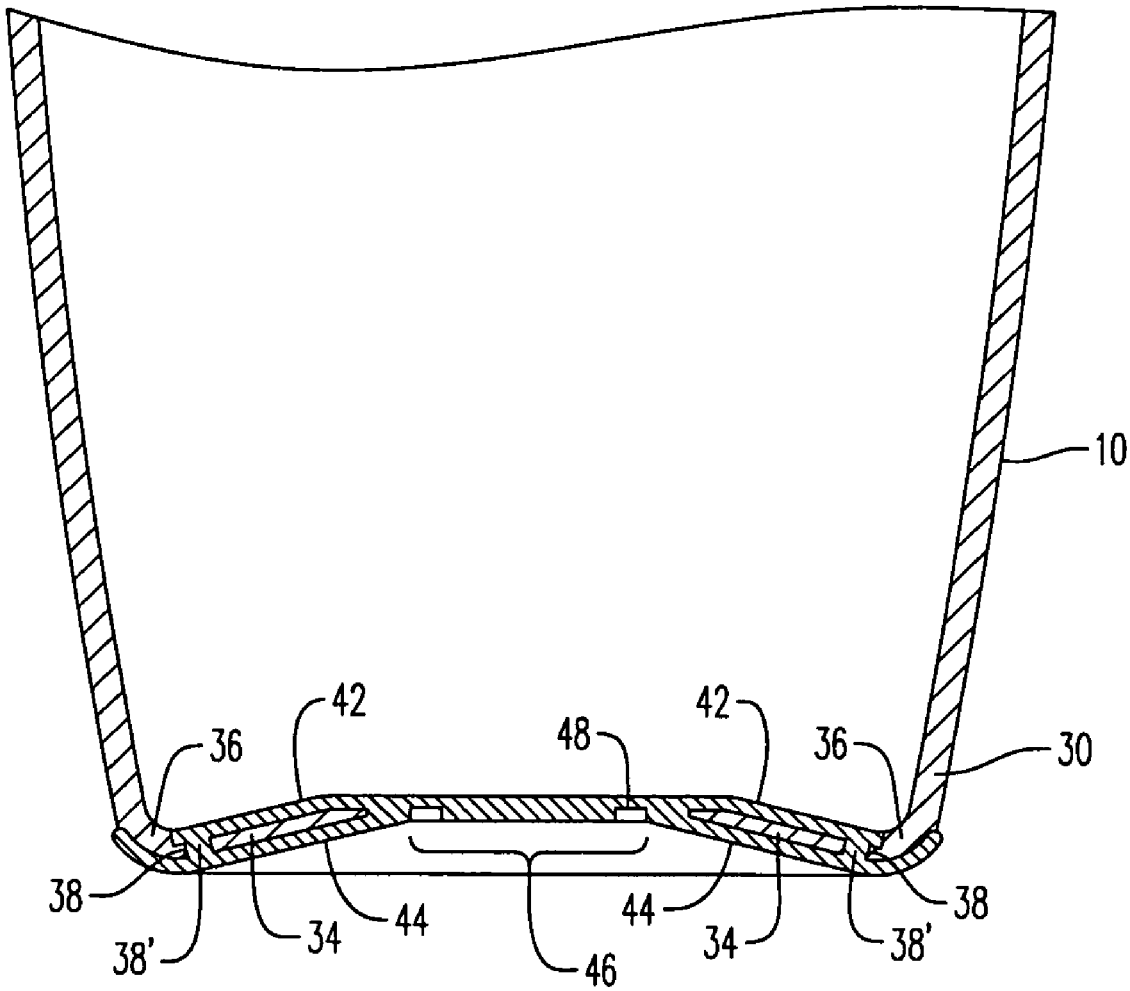
FIG. 4 is an enlarged view of the cup assembly of FIG. 3, highlighting not only the cup component and co-molded TPE bottom but also, vents disposed therein.

Referring to the drawings and in particular FIGS. 1 through 3, there is shown a spill proof cup assembly in accordance with a preferred embodiment of the present disclosure generally represented by reference numeral 1. Cup assembly 1 preferably has a cup or hollow body 10 with an upper end 20 and a lower end 30, and a flexible membrane 40 co-molded with lower end 30 to form a unitary container or device. Preferably, hollow body 10 and flexible membrane 40 are made of at least two distinct materials. These distinct materials preferably are polypropylene and thermoplastic elastomer (TPE), respectively. However, other materials such as for example high density polyethylene, polycarbonate, urethane rubber, and silicone may also be used. Further, hollow body 10 can be made of a more clarified, attractive brittle material.

Figure 5:
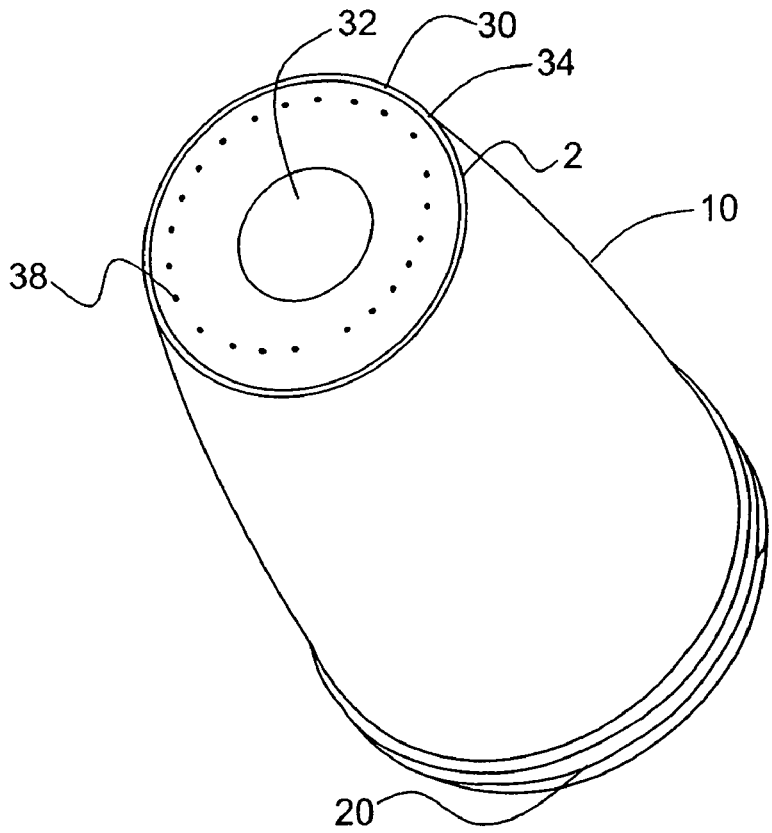
FIG. 5 is a bottom view of the cup assembly of FIG. 1, showing the polypropylene injection molded cup component before it is co-molded with TPE.
Figure 6:
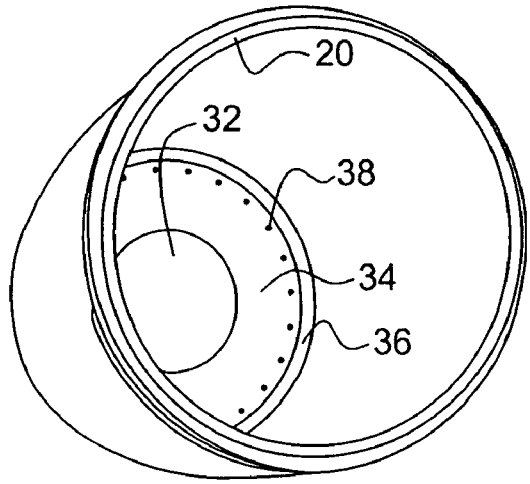
FIG. 6 is an interior bottom view of the cup assembly of FIG. 5.

Hollow body 10 preferably has an elongated central vertical axis A with an upper end 20 forming an upper opening 22 and a lower end 30 forming a lower opening 32 shown clearly in FIGS. 5 and 6. Preferably, upper end 20 selectively cooperates with a cap 24. Cap 24 preferably has at least one spout or fluid dispensing outlet 26. Upper end 20 preferably also has threads 21 for engaging corresponding threads 23 of cap 24. It should be noted, however, that upper end 20 may also be configured without threads such that cap 24 is snap fit over upper end 20. Preferably, lower end 30, as shown in FIGS. 3, 4, 5 and 6, has an inner flange 34 preferably running along a lower inner edge 36 of hollow body 10. Inner flange 34 preferably has one or more apertures 38 serving as passageways for elastomeric membrane material and as mechanical locks 38' when flexible membrane 40 is co-molded to hollow body 10.

Referring generally to FIGS. 1 through 8, preferably mechanical locks 38' are arranged such that when flexible membrane 40 is co-molded with hollow body 10, lower opening 32 is preferably filled with the elastomeric material or TPE and inner flange 34 is preferably sandwiched between two layers of TPE, an upper layer 42 and a lower layer 44. The result is a flexible membrane defining a vent area 46 that is actuated by differences in pressure. Preferably, mechanical locks 38' are provided within small apertures 38 advantageously situated in inner flange 34 and allowing upper layer 42 and lower layer 44 to be connected through the inner flange.

Figure 7:
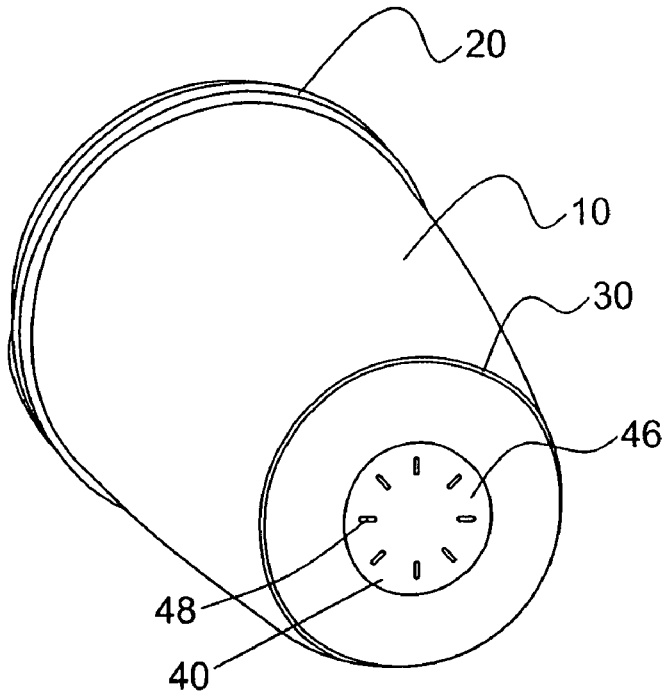
FIG. 7 is a bottom view of the cup assembly of FIG. 1, showing the polypropylene injection molded cup component after it is co-molded with TPE.
Figure 8:
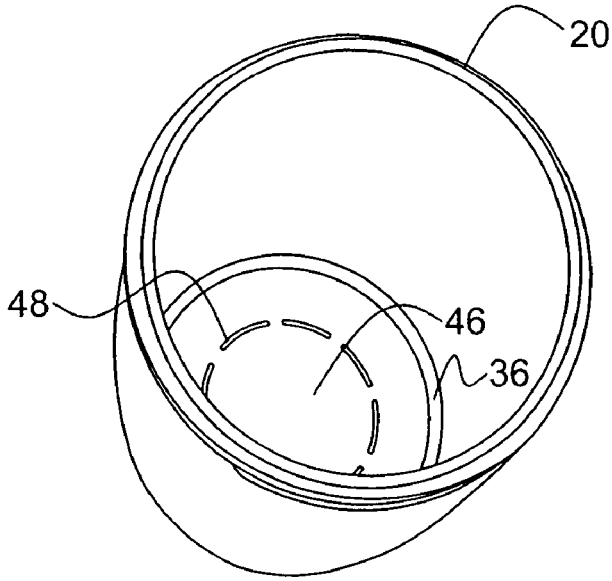
FIG. 8 is an interior bottom view of the cup assembly of FIG. 7.

Flexible membrane 40, preferably is soft and provides a cushioning protection for reducing the likelihood of the cup assembly being broken dropped or mishandled. Thus, the co-molding of flexible membrane 40 onto hollow body 10 preferably allows the hollow body to be formed from a more brittle material, which ordinarily would not be usable because of its more fragile nature. Vent area 46, preferably has one or more dimples or vents 48. Vents 48 preferably are molded into shape and pierced via a secondary operation. The result is a dimple/pierce that behaves as a pressure actuated valve for allowing air to enter the cup while preventing fluid from leaking out. Vents 48 are preferably positioned as shown in FIGS. 7 and 8, with the dimple side facing outwardly from lower end 30. This configuration is important, as there are mechanical advantages that can be leveraged therefrom. For example, as fluid pushes down on vents 48, the pressure preferably causes the adjacent surfaces of upper layer 42 and lower layer 44, which are fashioned by the secondary piercing operation, to be pressed against each other causing vents 48 to close. Conversely, when there is a vacuum within the cup and pressure builds on the outer side of vents 48, the adjacent surfaces of upper layer 42 and lower layer 44 separate causing vents 48 to open. Thus, the configuration shown in FIGS. 7 and 8, preferably facilitates lower end 30 being in compression with vents 48 closed, when there is a positive pressure in the cup, and in tension with vents 48 open, when there is a negative pressure in the cup. This provides the functional performance desired (i.e. a one way flow).

Cup assembly 1 is preferably configured to allow air to enter hollow body 10 through lower end 30 via vents 48 to replace fluid being removed from the cup via outlet spout 26 of cap 24. This helps reduce the vacuum that tends to develop within hollow body 10 as fluid exits during drinking.

Cup assembly 1 is preferably formed by injection molding hollow body 10 such that upper end 20 is open and lower end 30 is open with inner flange 34 reducing the cross-sectional area of the lower end opening to be less than that of the upper end opening. Once hollow body 10 is formed, flexible membrane 40 is preferably co-molded to lower end 30 such that the flexible membrane enfolds inner flange 34 and fills lower opening 32 to define vent area 46.

The present disclosure having been thus described with particular reference to the preferred forms thereof, it will be obvious that various changes and modifications may be made therein without departing from the spirit and scope of the present disclosure as defined herein.

What is claimed is:

1. A drinking container for holding a drinkable fluid, comprising:

a hollow body having a circumferential wall, a first end, a second end opposite the first end, and a lower inner edge connecting the circumferential wall to the second end, the lower inner edge having an annular inner flange that has an upper surface and a lower surface and defines a lower opening in the second end, a flexible membrane on the upper and lower surfaces of the annular inner flange to fill and close the lower opening and to form the second end, the flexible membrane filling and defining a vent area in the lower opening, said vent area having a plurality of slits therein, said plurality of slits being one-way pressure-activated valves for allowing air to enter therethrough into the container as the fluid exits the container.

2. The container of claim 1, wherein said inner flange has one or more apertures.

3. The container of claim 2, wherein said flexible membrane is co-molded to said second end such that said flexible membrane enfolds said inner flange and fills said one or more apertures.

4. The container of claim 3, wherein said inner flange has one or more apertures that form mechanical locks of said flexible membrane through said apertures when said flexible membrane is co-molded to said hollow body.

5. The container of claim 1, wherein said flexible membrane provides an exterior cushioning protection to said second end and to said lower inner edge for reducing the likelihood of the container being broken, dropped or mishandled.

6. The container of claim 1, wherein said flexible membrane on the lower surface of said annular inner flange also covers the lower surface of the lower inner edge.

7. A container for holding a fluid, comprising:

a hollow body having a lower end with a lower inner edge, and a lower opening;

an annular inner flange extending radially inwardly and upwardly of said lower inner edge, said annular inner flange defining the lower opening, said lower opening being filled with elastomeric membrane material that defines a vent area;

an elastomeric membrane defining and providing a planar horizontal vent area in the lower opening, said vent area having a plurality of slits or vents therein, said annular inner flange having a plurality of circumferentially spaced apertures that serve as passageways for elastomeric membrane material, said elastomeric membrane material residing within said passageways forming locks that connect an upper and a lower layer of elastomeric membrane to each other, so that said annular inner flange is sandwiched between and secured to said upper and lower layers of elastomeric membrane.

8. The container of claim 7, wherein said lower end has a lower opening radially inward of said flange.

9. The container of claim 8, wherein said flange has a radially inward edge that defines said lower opening, and wherein said lower opening is filled with said elastomeric membrane and forms said vent area.

10. The container of claim 9, wherein said flange has a plurality of apertures formed through said flange, and wherein said elastomeric membrane is at least partially disposed in said plurality of apertures.

11. The container of claim 7, wherein said flange has a cavity formed at least partially through said flange, and wherein said elastomeric membrane is at least partially disposed in said cavity.

12. The container of claim 7, wherein said one or more mechanical locks are non-planar structures thereby providing for mechanical attachment of said elastomeric membrane to said hollow body along said one or more mechanical locks.

13. The container of claim 7, wherein said lower end of said hollow body includes a bottom wall formed by said inner flange, said bottom wall having a lower opening therein, and wherein said elastomeric membrane enfolds said flange and traverses said lower opening.

14. A container for holding a liquid, comprising:

a hollow body having a lower end and an inner volume, said lower end including a bottom wall that forms a lower central opening therein, said bottom wall being formed by an annular inner flange that defines said central opening, said annular inner flange having a plurality of circumferentially spaced apertures therethrough that serve as passageways for flexible membrane material when said flexible membrane material is co-molded with said lower end of said hollow body; and a flexible membrane that is integral with said bottom wall of said hollow body and that forms a unitary container having a vent area, said flexible membrane being structurally connected to said bottom wall by said flexible membrane material extending through said apertures, through and filling said opening and forming a vent area of said central opening, wherein said vent area has multiple slits or vents that vent said inner volume such that air is selectively permitted to flow into said inner volume through said vent area and the fluid contained in said inner volume is substantially prevented from flowing out of said inner volume through said vent area, wherein said hollow body has a lowermost portion in the form of a lower inner edge, and wherein said flexible membrane is disposed on and structurally connected by flexible membrane material to said lowermost portion of said hollow body so that said disposed flexible membrane extends below and contacts the lowermost exposed exterior portion of said hollow body and provides direct cushioning protection to said hollow body and to said container directly against a substrate to reduce the likelihood of said container being broken, dropped or mishandled.

15. The container of claim 14, wherein said hollow body is a polypropylene material.

16. The container of claim 14, wherein said flexible membrane is thermoplastic elastomer.

17. The container of claim 14, wherein said hollow body annular inner flange lies along a lower inner edge of said second end, and wherein said flexible membrane contacts and has a lower layer extending below and around a bottom portion of said flange.

18. The container of claim 17, wherein said inner flange has one or more apertures.

19. The container of claim 18, wherein said flexible membrane is co-molded to said second end such that the flexible membrane enfolds said inner flange and fills said one or more apertures.

20. The container of claim 17, wherein said inner flange has one or more apertures that form mechanical locks when said flexible membrane is co-molded to said hollow body.

* * * * *